US007876194B2

(12) United States Patent
Ihle et al.

(10) Patent No.: US 7,876,194 B2
(45) Date of Patent: Jan. 25, 2011

(54) RESISTOR ARRANGEMENT

(75) Inventors: Jan Ihle, Deutschlandsberg (AT); Werner Kahr, Deutschlandsberg (AT); Helmut Poelzl, St. Martin i, S. (AT)

(73) Assignee: EPCOS AG, Munich (DE)

( * ) Notice: Subject to any disclaimer, the term of this patent is extended or adjusted under 35 U.S.C. 154(b) by 19 days.

(21) Appl. No.: 12/355,913

(22) Filed: Jan. 19, 2009

(65) Prior Publication Data

US 2009/0179731 A1 Jul. 16, 2009

Related U.S. Application Data

(63) Continuation of application No. PCT/DE2007/001295, filed on Jul. 19, 2007.

(30) Foreign Application Priority Data

Jul. 20, 2006 (DE) ..... 10 2006 033 710

(51) Int. Cl.
*H01C 3/06* (2006.01)
*H01C 7/00* (2006.01)

(52) U.S. Cl. ..... 338/212; 338/53; 219/211; 219/528; 29/610.1; 29/612

(58) Field of Classification Search ..... 338/51, 338/53, 55, 212; 219/211, 528, 549; 29/610.1, 29/611, 612
See application file for complete search history.

(56) References Cited

U.S. PATENT DOCUMENTS

| | | | |
|---|---|---|---|
| 3,878,362 | A | 4/1975 | Stinger |
| 4,072,848 | A | 2/1978 | Johnson et al. |
| 4,368,380 | A | 1/1983 | Igashira et al. |
| 4,450,347 | A | 5/1984 | Courvoisier et al. |
| 4,544,828 | A | 10/1985 | Shigenobu et al. |
| 4,721,848 | A | 1/1988 | Malone et al. |
| 4,899,032 | A | 2/1990 | Schwarzl et al. |
| 5,352,870 | A | 10/1994 | Daugherty et al. |
| 6,278,092 | B1 | 8/2001 | Wu |
| 6,350,969 | B1 | 2/2002 | Rothchild |
| 6,841,757 | B2 | 1/2005 | Marega et al. |
| 6,925,704 | B1 | 8/2005 | Schneekloth et al. |
| 7,102,484 | B2 | 9/2006 | Schneekloth et al. |
| 2003/0164361 | A1 | 9/2003 | Marega et al. |
| 2005/0184047 | A1 | 8/2005 | Cox et al. |
| 2005/0212649 | A1 | 9/2005 | Schneekloth et al. |

FOREIGN PATENT DOCUMENTS

| | | |
|---|---|---|
| DE | 83 09 023.1 | 2/1986 |
| DE | 601 06 757 T2 | 12/2005 |
| GB | 2 098 438 A | 11/1982 |
| WO | WO 86/01064 | 2/1986 |
| WO | WO 2004/105059 A1 | 12/2004 |

*Primary Examiner*—Kyung Lee
(74) *Attorney, Agent, or Firm*—Slater & Matsil, L.L.P.

(57) ABSTRACT

According to a first preferred embodiment, a resistor arrangement with resistor elements is specified whose first electrodes are conductively connected to each other by means of a flexible, conductive connection element that is curved. The connection element has changes in curvature in the regions arranged between two adjacent resistor elements. According to a second preferred embodiment, a resistor arrangement with resistor elements is specified that are connected to each other by a flexible connection element. The resistor elements each have an arrangement of slot-like recesses.

18 Claims, 4 Drawing Sheets

RESISTOR ARRANGEMENT

This application is a continuation of co-pending International Application No. PCT/DE2007/001295, filed Jul. 19, 2007, which designated the United States and was not published in English, and which claims priority to German Application No. 10 2006 033 710.7 filed Jul. 20, 2006, both of which applications are incorporated herein by reference.

BACKGROUND

A heating device with small grains made from PTC material distributed in a binding agent is known from the German patent publication DE 3107290 A1. A flexible heating device in a band shape is known from German patent publication DE 8309023 U1.

SUMMARY

In one aspect, the present invention specifies a resistor arrangement suitable for efficient heat output on a curved surface or for detecting a physical parameter of an object with a curved surface.

According to a first preferred embodiment, a resistor arrangement is specified with resistor elements that each have a first and a second electrode. The first electrodes of the resistor elements are conductively connected to each other by means of at least one flexible, curved first electrical connection element that exhibits changes in curvature in the regions arranged between two adjacent resistor elements.

The second electrodes of the resistor elements are advantageously conductively connected to each other by means of a flexible, curved second electrical connection element that exhibits changes in curvature in the regions arranged between two adjacent resistor elements. Below, the connection elements are also designated as supply lines.

The length of each electrical connection element measured between two adjacent resistor elements exceeds the minimum distance between these resistor elements. Thus, it is possible to prevent mechanical stress on the electrical connection elements when bending loads are exerted on the resistor arrangement.

The resistor elements are advantageously securely connected to a first flexible carrier film. They can also be securely connected to a second flexible carrier film. The resistor elements are advantageously arranged between the flexible carrier films. In a preferred variant, the features named below in connection with a flexible carrier film apply for both flexible carrier films.

The flexible carrier film can be a metal film. The flexible carrier film can also be composed of an elastic material in which each electrical connection element is inset in the form of a curved strip conductor.

A flexible insulation layer that at least partially fills the intermediate spaces formed between the resistor elements in the lateral direction can be arranged between the flexible electrical connection elements.

In one advantageous variant, the resistor elements and the flexible electrical connection elements are embedded in a flexible substrate, wherein they are advantageously encased in the substrate. The advantageously rubber-like substrate can contain silicone rubber. Other rubber-like, advantageously electrically insulating materials can be considered as a material for the substrate. In particular, materials that possess a high coefficient of thermal conductivity are suitable for this substrate.

For achieving a high coefficient of thermal conductivity, a filler that has a higher coefficient of thermal conductivity than a rubber-like base material can be added to the flexible, rubber-like material. For this purpose, electrically non-conductive or low-conduction materials, such as, e.g., SiC, MgO, ceramic, or metal oxide compounds can be advantageously used.

The resistor elements can be arranged between two flexible substrates, wherein the substrates are advantageously equatable with the carrier films mentioned above.

In one advantageous variant, the resistor elements, the flexible electrical compounds, and the carrier films are embedded, advantageously encased, in a flexible substrate.

Each electrical connection element can be integrated in the substrate. The connection element is advantageously realized as a curved strip conductor inset in the flexible substrate. The connection element can be composed of, for example, a stranded metal wire. Each electrical connection element can alternatively be realized as a laminated metal film arranged on the surface of each flexible carrier film. Each carrier film can be, e.g., a copper-laminated polyimide film or another flexible film that is electrically conductive or is composed of an electrically conductive film.

The minimum distance between the flexible electrical connection elements in the regions between the resistor elements can be smaller than the height of the resistor elements. The distance between the flexible electrical connections in such regions can also be greater than the height of the resistor elements.

The second electrodes of the resistor elements can be connected electrically in one variant by an electrically conductive area that contacts the resistor arrangement but is not a component of this arrangement.

In each flexible carrier film, recesses for holding resistor elements can be formed.

The resistor arrangement is advantageously composed of the same type of resistor element. At least one main surface of each resistor element can have an arrangement of slot-like recesses.

According to a second preferred embodiment, a resistor arrangement with resistor elements connected to each other by a flexible connection element is specified. The resistor elements each have an arrangement of slot-like recesses on at least one main surface. A significantly higher surface area of the resistor element is achieved by means of the slot-like recesses. In one advantageous variant, the slot-like recesses are advantageously completely filled with an elastic material that improves the heat extraction of the resistor arrangement.

Below, advantageous configurations of the resistor arrangement will be explained that apply for both preferred embodiments.

The resistor arrangement represents a planar structure whose length is measured in at least one lateral direction and is advantageously significantly greater, e.g., by at least a factor of 3, than its thickness. The flexible connection element is advantageously a planar substrate that carries the resistor elements.

The resistor elements advantageously have a plate-shaped or flat construction. The resistor elements are advantageously ceramic elements that each consist of an advantageously solid, rigid ceramic body. The material of the ceramic body advantageously has PTC properties and advantageously contains $BaTiO_3$. PTC stands for Positive Temperature Coefficient.

The ceramic body is advantageously constructed as a resistor film arranged between a first and a second electrode. The electrodes are advantageously arranged on the main surfaces of the resistor element. The second electrode is electrically insulated from the first electrode. The electrodes advantageously have a construction that breaks down the barrier layer.

Although in one advantageous variant each resistor element is rigid, the resistor arrangement with the deformable electrical connections is flexible. This has the advantage that it can also be applied to an arbitrarily shaped, also curved surface with a form-fit connection.

In one advantageous variant, the resistor elements are provided as heating elements. The resistor arrangement is advantageously a heating device. In another variant, the resistor elements are provided as sensor elements. Sensor elements are suitable for detecting a physical parameter, such as, e.g., temperature. In this case, the resistor arrangement is a sensor device.

The resistor arrangement can be produced, for example, in the following method.

Resistor elements provided with electrodes are produced. These are connected to each other by means of attachment to at least one electrically conductive film or at least one metal mesh. An electrically conductive film is understood to be a metal film or a film that has an electrically conductive layer arranged on a non-conductive carrier. Advantageously, first main surfaces of the resistor elements are connected to a first film, and their second main surfaces are connected to a second film, e.g., by means of soldering or adhesive bonding.

The intermediate spaces between the resistor elements are encased at least partially with an electrically insulating material that remains elastically deformable (flexible) after curing. In addition, a layer made from a flexible material can be deposited for forming a flexible substrate on at least one of the conductive films or metal meshes. Advantageously, the arrangement that is composed of the conductive films and the resistor elements mounted on these films is encased in flexible material. The flexible material advantageously has electrically insulating properties.

The electrically conductive film is advantageously shaped before it is embedded in the flexible material so that the electrical connections arranged between the resistor elements are lengthened relative to the minimum distance between these resistor elements. In particular, the electrical connections can be structured, and curved in cross section with respect to their height. The electrical connections can also have steps or form at least one part of a loop.

Therefore, curved electrical connection elements can be achieved such that recesses are formed in the electrically conductive film. The recesses can each be used for holding a resistor element. Also between the resistor elements there can be, e.g., groove-shaped recesses that contribute to relieving mechanical stress in the electrical connections when the resistor arrangement is bent.

The electrically conductive film or the metal mesh is soldered or adhesively bonded, advantageously before it is embedded in the flexible material, with electrical terminals accessible from the outside. The arrangement of mutually connected resistor elements with the terminals is then set in a mold and encased with the electrically insulating material, such as, e.g., silicone rubber. In order to prevent entrapped air, it can then be evacuated.

The resistor arrangement completed after curing of the flexible material can now be removed from the mold. It is flexible and can be used, in particular, for heating of objects, wherein the resistor arrangement can also be attached to a curved surface with a form-fit connection.

In another method, an optionally not yet cured carrier substrate (e.g., silicon film) is prepared in which is set a wire mesh or another structured strip conductor that has curves. This substrate is connected to a resistor substrate that is not yet composed of separated resistor elements. The connection of the substrates is realized such that the curved strip conductor contacts the main surface of the resistor substrate in the regions provided as resistor elements.

After the curing of the material of the carrier substrate, the resistor substrate can be separated into several resistor elements by cutting or sawing. The separation is realized so that only the resistor substrate is cut through, wherein the carrier substrate is only scored, without damaging the strip conductor set in this substrate. This can be realized with the use of a hard underlayer.

In this way, a composite is produced that is composed of, on one side, electrically and mechanically connected resistor elements. A two-sided electrical and mechanical connection of the resistor elements is also possible. Here, a main surface of the composite still not connected to any substrate is connected to a second carrier substrate in a similar method, wherein the second carrier substrate advantageously has the properties of the first carrier substrate.

An air gap that prevents a short circuit between the carrier substrates can be provided between the first and the second carrier substrate. The intermediate spaces provided between the carrier substrates and the resistor elements, however, can also be filled with an electrically insulating, flexible material having good thermal conductivity, such as, e.g., silicone rubber. For this purpose, the intermediate spaces formed between the resistor elements are advantageously encased with this material before the connection of the composite to the second carrier substrate.

The resistor elements can have advantageously slot-shaped recesses arranged in their main surfaces. These recesses are advantageously arranged in at least one main surface of the resistor elements. The electrode layers also cover the surface of these recesses.

BRIEF DESCRIPTION OF THE DRAWINGS

The specified resistor arrangement and also the method for its production will now be explained with reference to schematic figures that are not true to scale. Shown are.

Figure 1A:
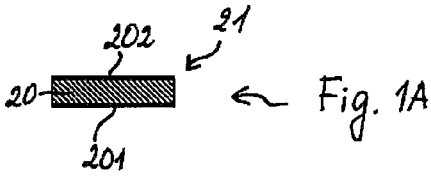
FIG. 1A, shows in cross section, an example resistor element.

The following list of reference symbols may be used in conjunction with the drawings:

1, 81 Flexible substrate
1*a* Base layer
1*b* Cover layer
10 Insulating layer
11, 13 Carrier film
12, 14 Metal layer
20 Body
201, 202 Electrodes of the resistor elements
21, 22, 23 Resistor elements
221, 222 Recesses
31, 32 Electrical terminals
41 Curved sections of the metal layer 12
7 Intermediate space
8 Filler
81, 82 Elastically deformable substrate
812, 822 Conductive layer
811, 821 Insulating layer
91, 92 Electrical connection element

DETAILED DESCRIPTION

In FIG. 1A, an example resistor element 21 is shown with a rigid body 20 on whose main surfaces electrodes 201, 202 are arranged. The resistance elements 21, 22, 23 shown in the following figures advantageously have identical constructions.

Figure 1B:
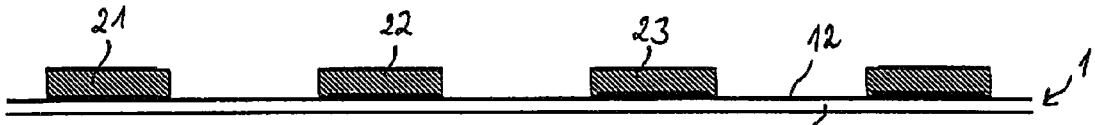
FIGS. 1B, 1C, show in cross section, resistor elements on a metal-clad carrier film.

The resistor elements 21, 22, 23 are mounted on a substrate 1 that is composed of a carrier film 11, e.g., made from polyimide. The substrate 1 has metal lamination, the metal layer 12, that is arranged on the carrier film 11 and turned toward the resistor elements (FIG. 1B). The mounting can be realized by means of soldering or adhesive bonding.

Figure 1C:
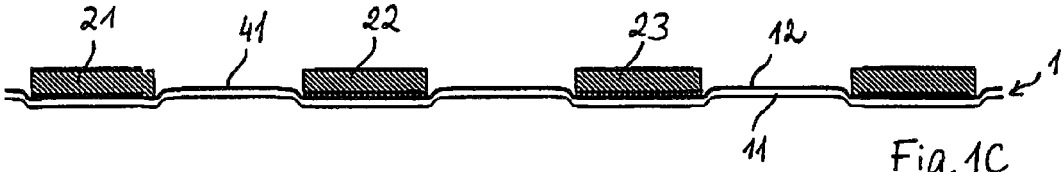

The metal-clad carrier film 11 is advantageously shaped as shown in FIG. 1C such that it has recesses for holding resistor elements 21, 22, 23. By means of these recesses, curved sections 41 of the metal layer 12 that are arranged between two successive resistor elements are formed. The flexible, curved electrical connection element is realized by means of the metal layer 12 that has curved sections.

The length of the curved sections 41 is greater than the minimum distance between these resistor elements. The shaping of the metal-clad carrier film 11 can be realized before or after the mounting of the resistor elements 21, 22, 23.

The metal-clad carrier film 11 shown in FIGS. 1B, 1C can also be replaced by a composite of a substrate and an electrically conductive layer. The metal layers 12, 14 can each be replaced by a metal mesh. It is always important that mechanical stress generated under a bending load can be prevented when the resistor arrangement is bent. This is possible because a structured and, therefore, longer electrical line can be relieved of mechanical stress when bent to a higher degree relative to a straight line.

Figure 1D:
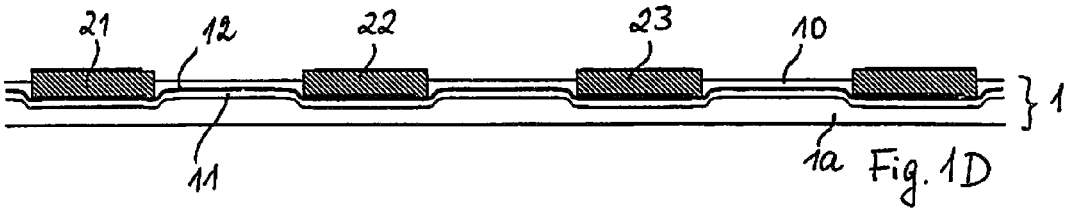
FIG. 1D, shows in cross section, the arrangement according to FIG. 1C that is embedded in a substrate.

In FIG. 1D, the arrangement shown in FIG. 1C is partially embedded between an electrically insulating base layer 1*a* and an insulating layer 10. Advantageously, the layers 1*a*, 10 are composed of the same material. They can be laminated, adhesively bonded, or created by a casting method.

Figure 1E:
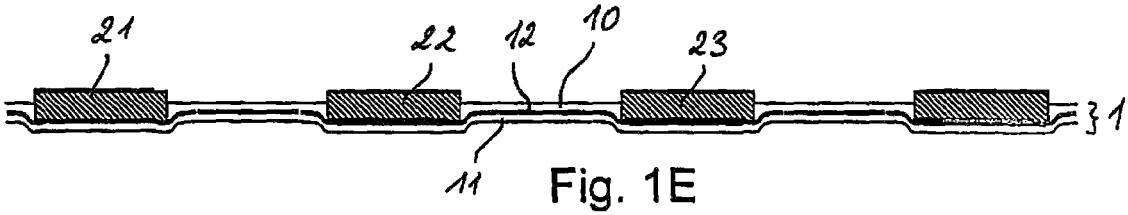
FIG. 1E, shows a resistor arrangement with resistor elements according to FIG. 1A that are partially embedded in an elastically deformable substrate.

The base layer 1*a* can also be eliminated, see FIG. 1E. In the arrangement shown in FIG. 1C, the intermediate spaces arranged between the resistor elements are partially filled with an insulating material. The elastically deformable substrate 1 in which the resistor elements 21, 22, 23 are partially embedded is, in this case, formed by the layers 10, 11.

The substrate 1 in which the resistor elements are partially embedded and the electrical connection element (the metal layer 12) is integrated is formed in the variant according to FIG. 1D by the base layer 1*a*, the carrier film 11, and the insulating layer 10. The substrate 1 can be further composed of a second carrier film 13, as in the variants according to FIGS. 1F and 2. The carrier film 13 advantageously has the same properties as the carrier film 11.

Figure 1F:
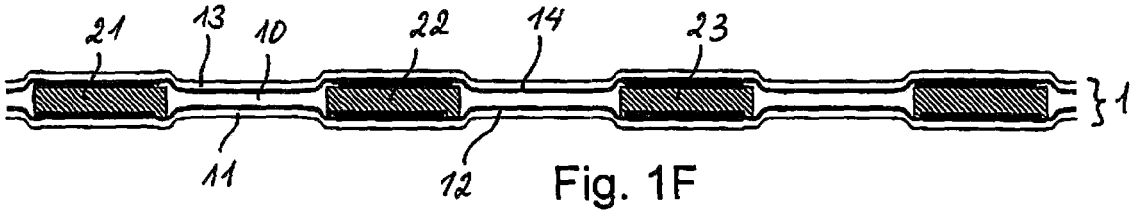
FIG. 1F, shows a resistor arrangement with resistor elements according to FIG. 1A that are arranged between two elastically deformable substrates.

The top side of the arrangement shown in FIG. 1E can be connected, as indicated in FIG. 1F, to an optionally pre-shaped, metal-clad carrier film 13. In the variant according to FIG. 1F, the substrate 1 is formed by the carrier films 11, 13 and the insulating layer 10. The metal-clad carrier films 11, 13 can be considered as two elastically deformable substrates between which the resistor elements are arranged.

Instead of metal-clad carrier films 11, 13, films made from a conductive, elastic material can be used in all of the embodiments.

Figure 2:
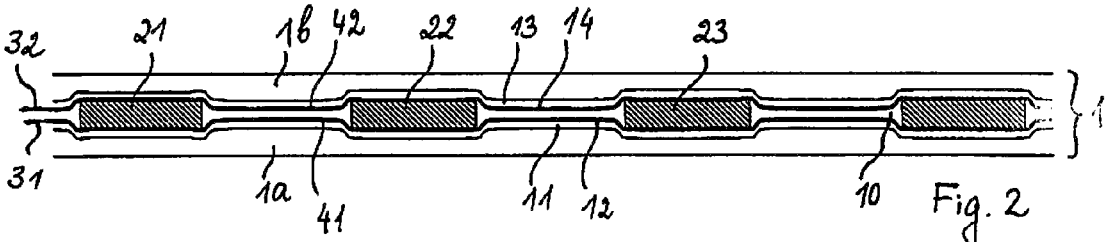
FIG. 2, shows in cross section, a resistor arrangement in which electrical connection elements are embedded for contacting first and second electrodes of the resistor elements in the substrate.

The substrate 1 can be further composed of a cover layer 1*b* as in the variant according to FIG. 2.

In the variant shown in FIG. 2, a second electrical connection element that conductively connects all of the second electrodes of the resistor elements to each other is realized by means of the second metal layer 14. The second metal layer 14 is advantageously constructed as metal lamination of the second carrier film 13. The metal lamination of the carrier film, i.e., the metal film 14, is turned inward, that is, toward the resistor elements. The metal layer 14 connects the second electrodes of the resistor elements.

The first metal layer 12 is connected to a first electrical terminal 31, and the second metal layer 14 is connected to a second electrical terminal 32 of the resistor arrangement. The terminals 31, 32 are accessible from the outside and can be connected, e.g., to a plug connection. The statement in connection with the carrier film 11 and the metal film 12 also applies to the second carrier film 13 shown in FIGS. 2, 3 and the metal layer 14 connected to this film.

One arrangement formed by the resistor elements 21, 22, 23 and its electrical connections is in FIG. 2 completely embedded in the substrate 1. There is an insulating layer 10 between these layers so that the metal layers 12 and 14 with different applied potentials do not contact each other.

Figure 3:
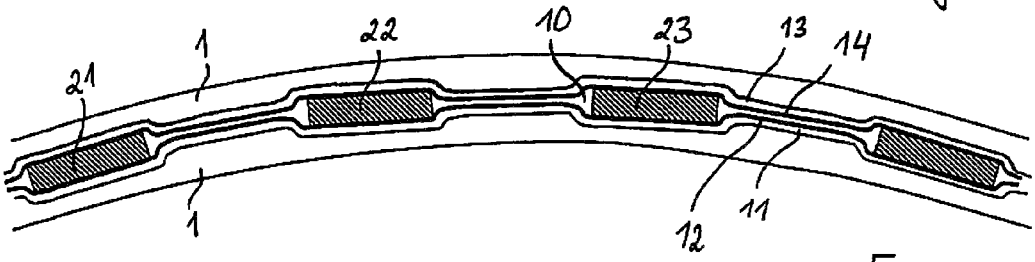
FIG. 3, shows in cross section, the resistor arrangement according to FIG. 2 that is adapted to a curved surface.

In FIG. 3, the heating arrangement according to FIG. 2 is shown that is adapted to a curved surface, not shown in FIG. 3.

Figure 4:
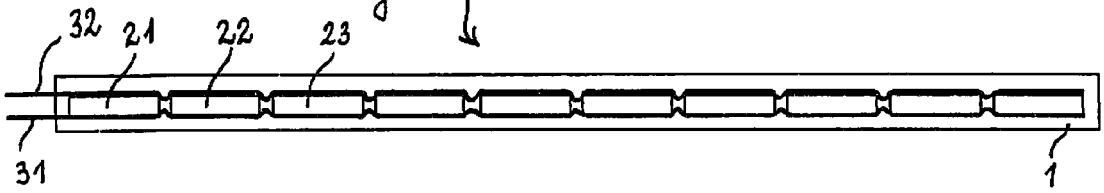
FIG. 4, shows in cross section, the resistor arrangement according to FIG. 5.

In FIG. 4, the resistor elements 21, 22, 23 are conductively connected to each other by means of an electrically conductive connection element, such as, e.g., a pre-shaped metal film or stranded metal wire. The arrangement formed by the resistor elements 21, 22, 23 and its electrical connections is here encased in substrate 1.

It is advantageous for at least one main surface of the substrate 1 to be planar. Advantageously, both main surfaces of the substrate 1 have a planar construction.

The resistor arrangement shown in FIGS. 1A to 4 can be provided in the form of a flexible band that has a one-dimensional arrangement of resistor elements 21, 22, 23.

Figure 5:
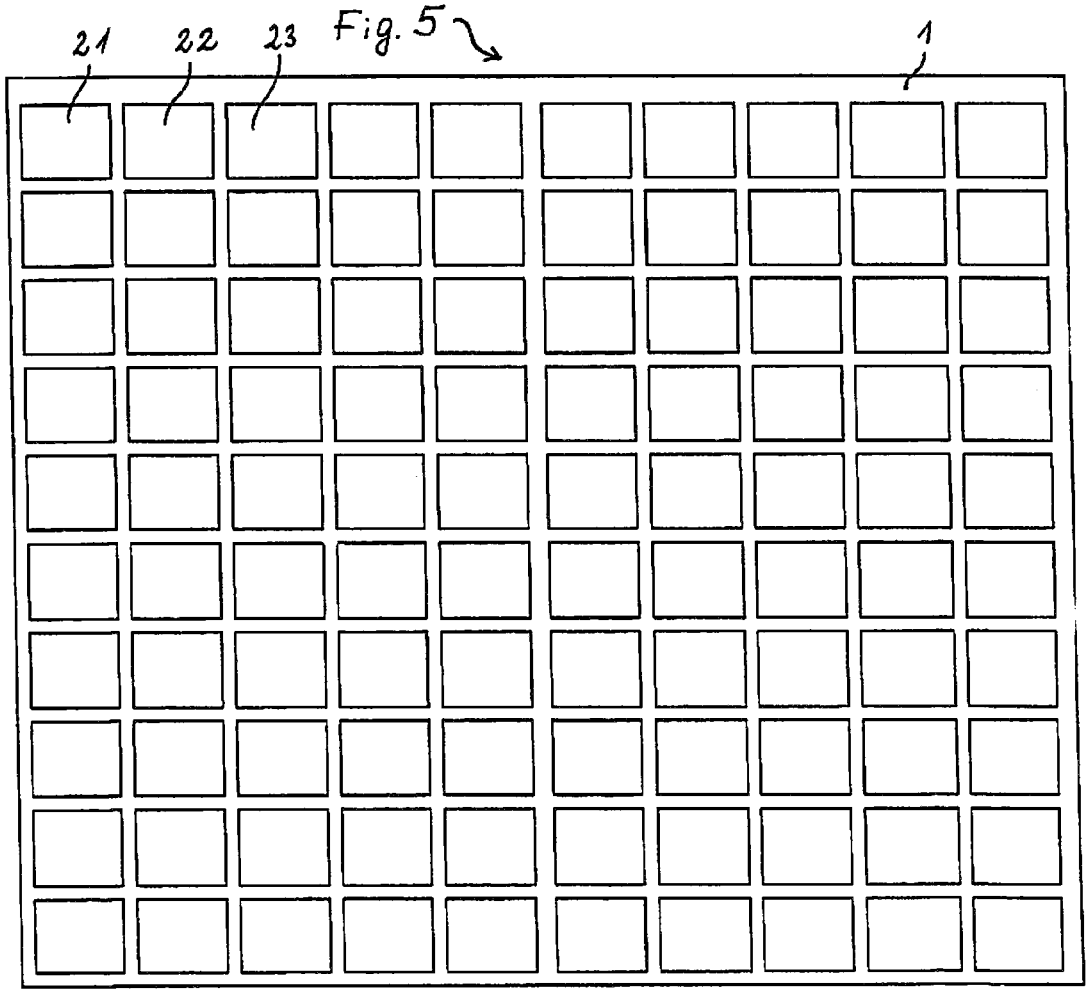
FIG. 5, shows a top view of a planar resistor arrangement.

In FIG. 5 is shown a planar resistor arrangement, i.e., a resistor arrangement with a two-dimensional arrangement of resistor elements. One such arrangement is produced after a resistor substrate, which is initially composed of resistor elements 21, 22, 23 that have not been separated, is cut through along the predetermined separating lines, wherein the carrier substrate 1 is not cut through.

The resistor elements shown in the figures explained above can be constructed as in FIGS. 6 to 8.

Figure 6:
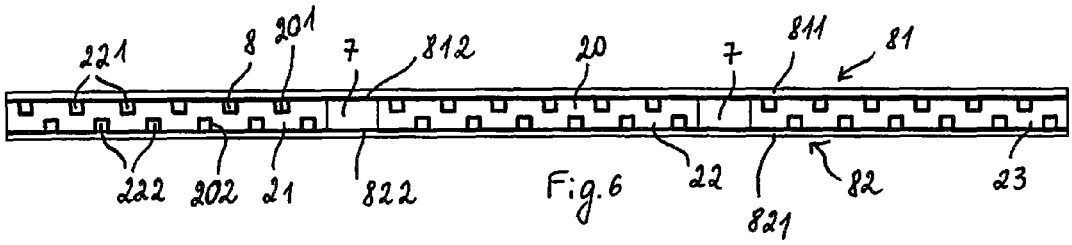
FIG. 6, shows a resistor arrangement with slotted resistor elements and two elastically deformable substrates.

In FIG. 6, a resistor arrangement with resistor elements is shown that has recesses 221, 222 arranged in their main surfaces. The first recesses 221 are arranged on a first main surface (top side) of a resistor element, and the second recesses 222 are arranged on its second main surface (bottom side). The electrode layers 201, 202 also cover the surface of these recesses.

The recesses 221, 222 are advantageously filled with a filling material 8 that has a better coefficient of thermal conductivity than the ceramic body of the resistor element. The intermediate space 7 between two resistor elements is advantageously also filled with an elastically deformable filler.

The second recesses 222 are laterally offset relative to the first recesses 221. The depth of the recesses can equal approximately half or more than half the thickness of the ceramic body.

The resistor elements are connected to each other mechanically by means of elastically deformable substrates 81, 82. Each substrate 81, 82 has an insulating layer 811, 821. Each substrate 81, 82 also has a conductive layer 812, 822 that is deposited on the insulating layer 811, 821, e.g., as a metal lamination, and is turned toward the resistor elements. The first electrode layers 201 of the resistor elements are conductively connected to each other by means of the conductive layer 812, and the second electrode layers 202 of the resistor elements are connected by means of the conductive layer 822. The layers 812, 822 are electrical connection elements that advantageously have a flexible and curved construction like the metal layers 12, 14. The layers 812, 822 can be metal meshes or metal films advantageously pre-shaped.

Figure 7A:
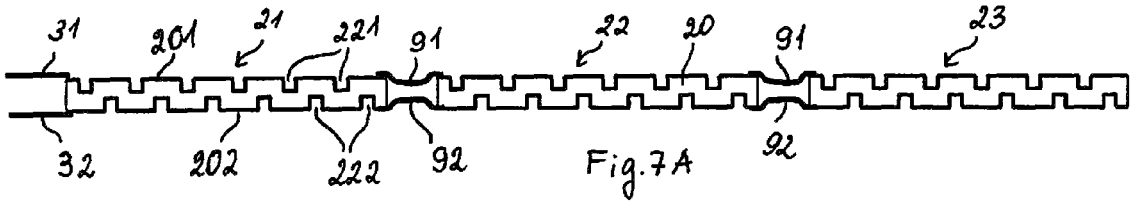
FIG. 7A, shows slotted resistor elements connected to each other electrically.
Figure 7B:
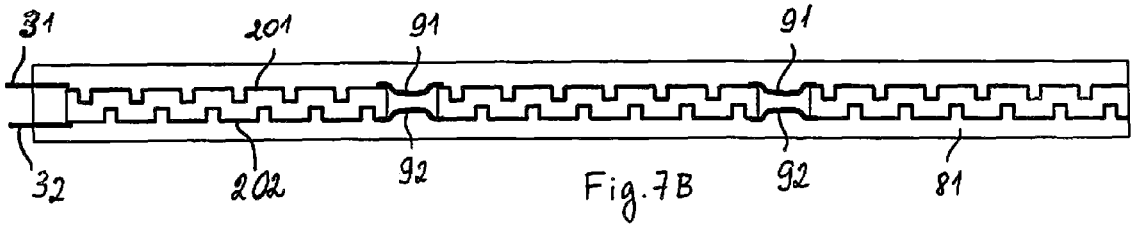
FIG. 7B, shows a resistor arrangement with slotted resistor elements embedded in a substrate and connected to each other electrically.

FIG. 7A shows an arrangement of resistor elements whose first electrode layers 201 are connected to each other electrically by means of an electrical connection element 91 and its second electrode layers 202 are connected by means of an electrical connection element 92.

The connection elements 91, 92 can be metal meshes or metal films that are advantageously pre-shaped such that the length of the connection element is greater than the distance between the resistor elements connected to each other. The first electrode layers 201 are conductively connected to an electrical terminal 31 that is accessible from the outside. The second electrode layers 202 are conductively connected to an electrical terminal 32 that is also accessible from the outside. The heating arrangement according to FIG. 7A embedded in a substrate 81 is presented in FIG. 7B.

What is claimed is:

1. A resistor arrangement comprising:

a plurality of resistor elements that each have a first electrode and a second electrode; and a flexible, curved first electrical connection element, wherein the first electrodes are conductively connected to each other by means of the first electrical connection element, the first electrical connection element exhibiting changes in curvature in regions arranged between two adjacent resistor elements;

a flexible, curved second electrical connection element, wherein the second electrodes are conductively connected to each other by means of the second electrical connection element, the second electrical connection element exhibiting changes in curvature in the regions arranged between the two adjacent resistor elements;

a first flexible carrier film, wherein the resistor elements are securely connected to the first flexible carrier film; and a second flexible carrier film, wherein the resistor elements are also securely connected to the second flexible carrier film.

2. The resistor arrangement according to claim 1, further comprising a flexible insulating layer arranged between the first and second electrical connection elements.

3. The resistor arrangement according to claim 1, further comprising a flexible substrate, wherein the first and second electrical connection elements are embedded in the flexible substrate, and wherein the resistor elements are embedded at least partially in the flexible substrate.

4. The resistor arrangement according to claim 1, further comprising a flexible substrate, wherein the resistor elements, the first and second electrical connection elements, and the carrier films are embedded in the flexible substrate.

5. The resistor arrangement according to claim 1, wherein a distance between the first and second electrical connection elements in regions lying between the resistor elements is less than a height of the resistor elements.

6. The resistor arrangement according to claim 1, wherein a distance between the first and second electrical connection elements in regions lying between the resistor elements is greater than a height of the resistor elements.

7. The resistor arrangement according to claim 1, wherein the first electrical connection element comprises a laminated metal layer arranged on the first flexible carrier film.

8. The resistor arrangement according to claim 1, wherein the first flexible carrier film includes recesses for holding resistor elements.

9. The resistor arrangement according to claim 7, wherein the second electrical connection element comprises a laminated metal layer arranged on the second flexible carrier film.

10. The resistor arrangement according to claim 1, wherein the first electrical connection element comprises a stranded metal wire.

11. The resistor arrangement according to claim 10, wherein the second electrical connection element comprises a stranded metal wire.

12. The resistor arrangement according to claim 3, wherein the first and second electrical connection elements are each realized as a curved strip conductor set in the flexible substrate.

13. The resistor arrangement according to claim 1, wherein at least one main surface of each resistor element has an arrangement of slot-like recesses.

14. A resistor arrangement comprising:

a flexible connection element; and resistor elements connected to each other by the flexible connection elements, wherein the resistor elements each have an arrangement of slot-like recesses that increase a surface area of the resistor elements.

15. The resistor arrangement according to claim 14, wherein the slot-like recesses are filled with a filling material whose coefficient of thermal conductivity exceeds that of the resistor elements.

16. A method for producing a resistor arrangement, the method comprising:

forming a composite by connecting a resistor substrate comprising resistor elements that have not yet been separated to a layer made from flexible material in which a curved strip conductor is set, wherein the connection is realized such that the curved strip conductor comes into contact with a main surface of the resistor substrate in regions provided as resistor elements; and cutting the composite such that only the resistor substrate is cut through, thereby producing several resistor elements that are connected to each other mechanically by the layer made from flexible material, and electrically by the curved strip conductor.

17. A method for producing a resistor arrangement, the method comprising:

securely connecting resistor elements on at least one side to a flexible, conductive film, thereby forming a composite;

pre-shaping the conductive film; and encasing the composite at least partially in a flexible material.

18. A resistor arrangement comprising:

a flexible connection element;

resistor elements connected to each other by the flexible connection elements, wherein the resistor elements each have an arrangement of slot-like recesses; and electrode layers that cover a surface of the slot-like recesses.

* * * * *